US010441023B2

(12) United States Patent
Lewis et al.

(10) Patent No.: US 10,441,023 B2
(45) Date of Patent: Oct. 15, 2019

(54) FLOW INSOLE

(71) Applicant: Implus Footcare, LLC, Durham, NC (US)

(72) Inventors: Paul Lewis, Beeton (CA); David Bradley Granger, Lorena, TX (US); Jacob Martinez, Temple, TX (US); William Sterling Wynn, Crawford, TX (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 231 days.

(21) Appl. No.: 14/295,786

(22) Filed: Jun. 4, 2014

(65) Prior Publication Data

US 2014/0283409 A1 Sep. 25, 2014

Related U.S. Application Data

(63) Continuation of application No. 13/363,296, filed on Jan. 31, 2012.

(Continued)

(51) Int. Cl.
*A43B 7/00* (2006.01)
*A43B 17/00* (2006.01)

(Continued)

(52) U.S. Cl.
CPC ..... *A43B 7/005* (2013.01); *A43B 7/06* (2013.01); *A43B 13/38* (2013.01); *A43B 17/006* (2013.01);

(Continued)

(58) Field of Classification Search
CPC ..... A43B 17/00; A43B 17/003; A43B 17/006; A43B 17/08; A43B 17/10; A43B 7/141; A43B 7/144; A43B 7/148; A43B 7/087

(Continued)

(56) References Cited

U.S. PATENT DOCUMENTS 333,595 A 1/1886 Butterfield
360,127 A 3/1887 Wallis (Continued)

FOREIGN PATENT DOCUMENTS

DE 2603716 12/1976
EP 0774219 12/1997

(Continued)

OTHER PUBLICATIONS

PCT, International Search Report & Written Opinion of the International Searching Authority for Counterpart International Patent Application No. PCT/US2006/014681, dated Jul. 27, 2006.

(Continued)

*Primary Examiner* — Megan E Lynch
(74) *Attorney, Agent, or Firm* — Buchanan Ingersoll & Rooney PC

(57) ABSTRACT

An insole which generates an air flow during use, which assists in cooling or warming the foot of a user is disclosed. In a first embodiment, air flow facilitated by said insole provides for convective heat transfer away from the plantar surface of the foot. The insole is intended for insertion into a shoe which is ventilated, preferably an athletic shoe with a ventilated upper. The bottom layer defines a plurality of ridges and channel lining portions which together define a plurality of air channels. The bottom layer defines a heel recess in which a heel pad is situated. In a second embodiment, an insole which collects, retains, and heats a user's foot is disclosed. Said insole further comprises a middle layer of thermal reflective material secured to and coextensive with a top layer and a bottom layer secured to said middle layer.

33 Claims, 12 Drawing Sheets

Related U.S. Application Data

(60) Provisional application No. 61/438,963, filed on Feb. 2, 2011, provisional application No. 61/509,979, filed on Jul. 20, 2011.

(51) Int. Cl.

| | |
|---|---|
| ***A43B 17/08*** | (2006.01) |
| ***A43B 17/10*** | (2006.01) |
| ***A43B 17/14*** | (2006.01) |
| ***A43B 7/06*** | (2006.01) |
| ***A43B 13/38*** | (2006.01) |

(52) U.S. Cl.
CPC ..... *A43B 17/08* (2013.01); *A43B 17/102* (2013.01); *A43B 17/14* (2013.01)

(58) Field of Classification Search
USPC ..... 36/44, 43
See application file for complete search history.

(56) References Cited

U.S. PATENT DOCUMENTS 892,360 A 6/1908 Burns
1,559,324 A 10/1925 Jensen
1,693,122 A 11/1928 Schwartz
1,718,906 A 6/1929 Hurley
1,811,641 A 6/1931 Marcelle
1,861,969 A 6/1932 Leighton, Jr.
1,920,112 A 7/1933 Shaft
1,945,780 A 2/1934 Johnson
2,031,510 A 2/1936 Stewart et al.
2,045,844 A 6/1936 Everston
2,055,574 A 9/1936 Hartl
2,090,881 A 8/1937 Wilson
2,207,437 A 7/1940 Marks et al.
2,224,590 A 12/1940 Boivin
2,224,642 A 12/1940 Burns
2,284,947 A 6/1942 Clifford
2,302,706 A * 11/1942 Meyer ..... A43B 17/08 36/3 B
2,347,207 A 4/1944 Margolin
2,408,564 A 10/1946 Lea
D149,889 S 6/1948 Laybolt
2,502,774 A 4/1950 Alianiello
2,553,616 A 5/1951 Walls
2,790,254 A 4/1957 Burns
2,827,050 A 3/1958 Fisher
2,857,689 A 10/1958 Van Ostrom et al.
2,985,971 A 5/1961 Murawski
3,084,695 A 4/1963 O'Donnell
3,154,867 A 11/1964 Strope
3,475,836 A 11/1969 Brahm
3,992,801 A 11/1976 McDiarmid et al.
D243,642 S 3/1977 Voorhees
4,020,570 A 5/1977 Shames
4,033,054 A 7/1977 Fukuoka
D246,486 S 11/1977 Nickel
4,071,963 A 2/1978 Fukuoka
4,108,928 A 8/1978 Swan, Jr.
4,123,855 A 11/1978 Thedford
4,139,337 A 2/1979 David et al.
4,150,455 A 4/1979 Fukuoka
4,179,826 A 12/1979 Davidson
4,215,492 A 8/1980 Sandmeier
4,219,945 A 9/1980 Rudy
4,223,457 A 9/1980 Borgeas
4,229,546 A 10/1980 Swan, Jr.
4,237,626 A 12/1980 Brown
4,263,728 A 4/1981 Frecentese
4,309,831 A 1/1982 Pritt
4,316,332 A 2/1982 Giese et al.
4,325,380 A 4/1982 Malkin
4,346,205 A 8/1982 Hiles
4,346,525 A 8/1982 Larsen et al.
4,364,188 A 12/1982 Turner et al.
4,408,402 A 10/1983 Looney
4,413,429 A 11/1983 Power
4,453,322 A 6/1984 Marsh
1,541,186 A 9/1985 Mulvihill
4,541,184 A 9/1985 Leighton
4,546,555 A 10/1985 Spademan
4,557,060 A 12/1985 Kawashima
4,581,187 A 4/1986 Sullivan et al.
4,584,782 A 4/1986 Thatcher
4,616,430 A 10/1986 McQuiggin
4,619,056 A 10/1986 Lin et al.
4,627,178 A 12/1986 Sullivan et al.
4,627,179 A 12/1986 McElroy
4,633,597 A 1/1987 Shiang
4,633,598 A 1/1987 Moronaga et al.
4,633,877 A 1/1987 Pendergast
D288,383 S 2/1987 Autry
4,674,204 A 6/1987 Sullivan et al.
4,694,589 A 9/1987 Sullivan et al.
4,694,831 A 9/1987 Seltzer
4,729,179 A 3/1988 Quist, Jr.
D295,690 S 5/1988 Finn
D299,583 S 1/1989 Tong et al.
4,800,657 A 1/1989 Brown
4,813,160 A 3/1989 Ktiznetz
4,860,463 A 8/1989 Pin
4,864,736 A 9/1989 Bierk
4,864,740 A 9/1989 Oakley
4,876,758 A 10/1989 Rolloff et al.
4,887,368 A 12/1989 Latzke
4,888,841 A 12/1989 Cumberland
4,888,887 A 12/1989 Solow
4,928,404 A 5/1990 Scheuermann
D311,269 S 10/1990 Graham et al.
4,974,342 A 12/1990 Nakamura
5,010,661 A 4/1991 Chu
5,014,706 A 5/1991 Philipp
5,025,573 A 6/1991 Giese et al.
5,025,575 A 6/1991 Lakic
5,027,461 A 7/1991 Cumhereand
5,035,068 A 7/1991 Biasi
D319,919 S 9/1991 Niarhos
D324,761 S 3/1992 Soo-Kwan
5,092,060 A 3/1992 Frachey et al.
5,138,775 A 4/1992 Chu
5,155,927 A 10/1992 Bates et al.
5,175,946 A * 1/1993 Tsai ..... A43B 17/03 36/29
5,184,409 A 2/1993 Brown
5,197,207 A 3/1993 Shorten
5,201,125 A 4/1993 Shorten
D336,718 S 6/1993 Schroer, Jr.
5,224,277 A 7/1993 Sang Do
5,233,767 A 8/1993 Kramer
D342,374 S 12/1993 Wang
5,282,324 A 2/1994 Cheng
D346,480 S 5/1994 Davidson
D348,146 S 6/1994 Nakano
D349,393 S 8/1994 Mishan
5,333,397 A 8/1994 Hausch
D350,432 S 9/1994 Saez
D350,848 S 9/1994 Tzenos
5,363,570 A * 11/1994 Allen ..... A43B 13/20 36/114
5,367,791 A 11/1994 Gross et al.
D353,710 S 12/1994 Brazzell
5,369,896 A 12/1994 Frachey et al.
5,375,346 A 12/1994 Cole et al.
5,400,528 A 3/1995 Skinner et al.
5,400,526 A 4/1995 Sessa
5,408,761 A 4/1995 Gazzano
5,430,960 A 7/1995 Richardson
5,438,768 A 8/1995 Bauerfeind
5,443,529 A 8/1995 Phillips
5,467,536 A 11/1995 Ramer et al.
5,493,791 A 2/1996 Kramer
D367,953 S 3/1996 King
5,509,938 A 4/1996 Phillips

(56) References Cited

U.S. PATENT DOCUMENTS 5,524,364 A 6/1996 Cole et al.
5,545,463 A 8/1996 Schmidt et al.
D374,549 S 10/1996 McDonald
5,615,496 A 4/1997 Sharpstein
5,619,809 A 4/1997 Sessa
5,640,779 A 6/1997 Rolloff et al.
D380,290 S 7/1997 Nakagawa
D383,894 S 9/1997 Snyder et al.
5,669,162 A 9/1997 Dyer
D384,797 S 10/1997 Nakagawa
5,675,914 A * 10/1997 Cintron ..... A43B 17/08 36/29
5,678,328 A 10/1997 Schmidt et al.
5,685,094 A 11/1997 Lin
D388,947 S 1/1998 Sessa
D389,296 S 1/1998 Sessa
D389,996 S 2/1998 Sessa
5,714,098 A 2/1998 Potter
5,722,186 A 3/1998 Brown
5,732,481 A 3/1998 Farhad
5,768,801 A * 6/1998 Huff ..... A43B 7/1425 12/142 D
5,771,606 A 6/1998 Litchfield et al.
5,775,005 A 7/1998 McClelland
D396,948 S 8/1998 Moore et al.
5,802,737 A 9/1998 Beppu
D399,042 S 10/1998 Strawser et al.
5,815,949 A * 10/1998 Sessa ..... A43B 1/0072 36/28
5,845,418 A * 12/1998 Chi ..... A43B 17/08 36/3 B
5,846,063 A 12/1998 Lakic
5,852,885 A 12/1998 Ferniani
D403,847 S 1/1999 Blythe
5,879,725 A 3/1999 Potter
D411,759 S 7/1999 Byrd
D418,666 S 1/2000 Brown
D420,210 S 2/2000 Allen
D420,788 S 2/2000 Kitagawa
6,029,372 A 2/2000 Pan
D423,765 S 5/2000 Autry
D425,690 S 5/2000 Bray et al.
D426,118 S 6/2000 Thomas
6,070,342 A 6/2000 Brown
6,079,123 A 6/2000 Clark
D428,689 S 8/2000 Guiotto et al.
D429,063 S 8/2000 Rose
6,105,283 A 8/2000 Park
D432,769 S 10/2000 Yung et al.
6,151,801 A 11/2000 Frederiksen et al.
6,176,025 B1 1/2001 Patterson et al.
D441,947 S 5/2001 Escobar et al.
6,233,847 B1 5/2001 Brown
6,266,897 B1 * 7/2001 Seydel ..... A43B 13/16 36/25 R
D448,542 S 10/2001 Bryant
6,301,805 B1 10/2001 Howlett et al.
D456,128 S 4/2002 Evans et al.
D460,854 S 7/2002 Hung
6,425,195 B1 7/2002 Donzis
6,453,578 B1 9/2002 Yung et al.
D465,079 S 11/2002 Merceron
6,481,120 B1 * 11/2002 Xia ..... A43B 13/12 36/140
6,497,057 B1 12/2002 Lee et al.
6,502,330 B1 1/2003 David et al.
6,510,626 B1 1/2003 Greenawalt
6,519,874 B1 2/2003 Dean
D471,001 S 3/2003 Beck
6,536,137 B1 * 3/2003 Celia ..... A43B 1/0045 36/28
6,553,690 B2 4/2003 Di Girolamo
D474,331 S 5/2003 Dean
D474,588 S 5/2003 Dean
D474,881 S 5/2003 Su
D475,844 S 6/2003 Reynolds et al.
6,581,303 B1 6/2003 Tuan
6,598,319 B2 7/2003 Hardt
6,618,960 B2 9/2003 Brown
6,631,568 B2 10/2003 Howlett et al.
D485,425 S 1/2004 Polifroni
D485,426 S 1/2004 Di Girolamo
6,671,979 B2 1/2004 Cardarelli
6,684,532 B2 2/2004 Greene et al.
D489,520 S 5/2004 Matis et al.
D495,123 S 8/2004 Wakatake
D497,473 S 10/2004 Martinez
D497,708 S 11/2004 Granger et al.
D500,914 S 1/2005 Ammon
6,880,266 B2 4/2005 Schoenborn et al.
6,915,598 B2 7/2005 Grisoni et al.
6,959,505 B2 11/2005 Poe
6,967,044 B1 11/2005 O'Brien
7,082,702 B2 8/2006 Cretinon
7,107,705 B2 9/2006 Dalton et al.
D529,691 S 10/2006 Earle
D543,685 S 6/2007 Andersen et al.
7,284,342 B2 10/2007 Avent et al.
7,316,081 B1 1/2008 Cheng
D563,649 S 3/2008 Andersen et al.
D576,391 S 9/2008 Contreras
D576,394 S 9/2008 Heller
7,437,836 B2 10/2008 Kim
D584,885 S 1/2009 Contreras
7,484,319 B2 * 2/2009 Cheskin ..... A43B 7/141 36/144
D592,386 S 5/2009 Baker et al.
D593,742 S 6/2009 Issler
D594,640 S 6/2009 McMillan
D596,833 S 7/2009 Dominguez et al.
7,555,849 B2 * 7/2009 Canvin ..... A43B 7/142 36/140
7,610,696 B2 * 11/2009 Davis ..... A43B 3/26 36/155
7,665,169 B2 2/2010 Cheskin et al.
D611,237 S * 3/2010 Torrance ..... D2/961
7,712,229 B2 5/2010 Yang
D617,086 S 6/2010 Avent et al.
D617,087 S 6/2010 Avent et al.
D634,924 S 3/2011 Cheskin et al.
7,900,380 B2 3/2011 Rich
7,908,768 B2 3/2011 Cheskin et al.
D656,716 S 4/2012 Eades
8,186,081 B2 5/2012 Wilson et al.
8,241,450 B2 8/2012 Hensley et al.
8,745,894 B2 6/2014 Cheskin et al.
2001/0000369 A1 4/2001 Snyder et al.
2001/0045028 A1 * 11/2001 Crane ..... A43B 7/1415 36/44
2002/0050080 A1 * 5/2002 Vasyli ..... A43B 7/141 36/145
2002/0092203 A1 7/2002 Hardt
2002/0116840 A1 8/2002 Kraft
2003/0009915 A1 1/2003 Bacon
2003/0024134 A1 2/2003 Howlett et al.
2003/0070321 A1 4/2003 Davis et al.
2003/0093920 A1 5/2003 Greene et al.
2003/0121180 A1 7/2003 Poe
2003/0136025 A1 * 7/2003 Galbraith ..... A43B 7/144 36/43
2003/0150134 A1 8/2003 Hardt
2004/0020075 A1 * 2/2004 Garneau ..... A43B 7/087 36/3 B
2004/0025374 A1 * 2/2004 Basso ..... A43B 1/0081 36/10
2004/0118017 A1 * 6/2004 Dalton ..... A43B 7/142 36/44
2004/0181971 A1 * 9/2004 Turkbas ..... A43B 7/141 36/44
2004/0194344 A1 * 10/2004 Tadin ..... A43B 7/141 36/44
2005/0138847 A1 6/2005 Blackburn et al.

(56) References Cited

U.S. PATENT DOCUMENTS

| | | | | |
|---|---|---|---|---|
| 2005/0262736 | A1 | 12/2005 | Peoples | |
| 2006/0010717 | A1* | 1/2006 | Finkelstein | A43B 13/187 36/25 R |
| 2006/0016099 | A1 | 1/2006 | Marco et al. | |
| 2006/0026779 | A1 | 2/2006 | Berg et al. | |
| 2006/0026865 | A1* | 2/2006 | Grisoni | A43B 17/026 36/43 |
| 2006/0096124 | A1 | 5/2006 | Moseley | |
| 2006/0123664 | A1 | 6/2006 | Boyd et al. | |
| 2006/0130367 | A1 | 6/2006 | Liu | |
| 2006/0137216 | A1* | 6/2006 | Ahlbaumer | A43B 7/06 36/3 B |
| 2006/0168846 | A1* | 8/2006 | Juan | A43B 17/08 36/3 B |
| 2006/0230643 | A1 | 10/2006 | Affleck | |
| 2006/0254088 | A1* | 11/2006 | McCormick | A41D 31/0038 36/44 |
| 2006/0283043 | A1* | 12/2006 | Lamstein | A43B 7/087 36/3 B |
| 2007/0022630 | A1* | 2/2007 | Lundy, Jr. | A43B 7/144 36/28 |
| 2007/0033834 | A1 | 2/2007 | Cheskin et al. | |
| 2007/0039209 | A1 | 2/2007 | White | |
| 2007/0245592 | A1 | 10/2007 | Yamaguchi et al. | |
| 2007/0261268 | A1 | 11/2007 | Nguyen | |
| 2008/0028637 | A1 | 2/2008 | Benfatti | |
| 2008/0110060 | A1 | 5/2008 | Ritter | |
| 2008/0110064 | A1* | 5/2008 | Liu | A43B 17/08 36/3 B |
| 2008/0271340 | A1* | 11/2008 | Grisoni | A43B 7/142 36/43 |
| 2008/0295358 | A1* | 12/2008 | Lin | A43B 17/08 36/43 |
| 2009/0049712 | A1 | 2/2009 | Steszyn et al. | |
| 2009/0100722 | A1 | 4/2009 | Hoffer et al. | |
| 2009/0151194 | A1 | 6/2009 | Cheskin et al. | |
| 2009/0165334 | A1* | 7/2009 | Kantro | A43B 3/24 36/91 |
| 2009/0249650 | A1 | 10/2009 | Sarantakos | |
| 2010/0015869 | A1 | 1/2010 | Hartmann et al. | |
| 2010/0083534 | A1 | 4/2010 | Howlett | |
| 2010/0095552 | A1 | 4/2010 | Cheskin et al. | |
| 2010/0126044 | A1 | 5/2010 | Davis | |
| 2010/0170116 | A1 | 7/2010 | Shim | |
| 2010/0205831 | A1 | 8/2010 | Checkin et al. | |
| 2010/0212187 | A1* | 8/2010 | Jones | A43B 3/0047 36/44 |
| 2010/0218398 | A1 | 9/2010 | Reinhardt et al. | |
| 2010/0218399 | A1* | 9/2010 | Jeong | A43B 7/141 36/44 |
| 2010/0251577 | A1* | 10/2010 | Yamada | A43B 13/04 36/25 R |
| 2011/0072685 | A1* | 3/2011 | Gutowsky, Jr. | A43B 7/142 36/44 |
| 2011/0131835 | A1 | 6/2011 | Cheskin | |
| 2011/0162234 | A1* | 7/2011 | Dean | A43B 7/144 36/43 |
| 2011/0209360 | A1 | 9/2011 | Baker et al. | |
| 2011/0219642 | A1 | 9/2011 | Sulak et al. | |
| 2011/0232129 | A1 | 9/2011 | Roberts et al. | |
| 2011/0252665 | A1* | 10/2011 | Tsai | A43B 7/144 36/44 |
| 2011/0252671 | A1 | 10/2011 | Maron et al. | |
| 2011/0302805 | A1 | 12/2011 | Vito | |
| 2012/0090197 | A1* | 4/2012 | Wyner | A43B 1/0045 36/44 |
| 2012/0192452 | A1* | 8/2012 | Lewis | A43B 17/006 36/44 |
| 2012/0272546 | A1* | 11/2012 | Tsai | A43B 3/0078 36/44 |
| 2013/0104419 | A1* | 5/2013 | Horesh | A43B 7/1425 36/43 |
| 2013/0160331 | A1 | 6/2013 | Burke | |

FOREIGN PATENT DOCUMENTS

| | | | | |
|---|---|---|---|---|
| KR | 10-0427687 | | 4/2006 | |
| KR | 10-0641278 | | 10/2006 | |
| KR | 10-0736813 | | 7/2007 | |
| KR | 10-0780086 | | 11/2007 | |
| WO | WO 2004060095 | | 7/2004 | |
| WO | WO 2006035469 | | 4/2006 | |
| WO | WO 2006090398 | | 8/2006 | |
| WO | WO 2007021328 | | 2/2007 | |
| WO | WO 2007056101 | | 5/2007 | |
| WO | WO 2009126111 | | 10/2009 | |
| WO | WO 2009136685 | A1 * | 11/2009 | A43B 1/0009 |
| WO | WO 2011108011 | A1 * | 9/2011 | A43B 1/0009 |

OTHER PUBLICATIONS

PCT, International Search Report & Written Opinion of the International Searching Authority for Counterpart International Patent Application No. PCT/2013/057141, dated Nov. 12, 2013.

PCT, International Search Report & Written Opinion of the International Searching Authority for Counterpart International Patent Application No. US2014/055133, dated Jan. 15, 2015.

[Online] [retrieved on Jan. 22, 2013] [retrieved from Foot Science Limited website] (pdf) http://www.footscience.com/products_foot.html.

[Online] [retrieved on Jan. 22, 2013] [retrieved from geldoctor website] (pdf) http://www.geldoctor.com/flosole.html.

[Online] [retrieved on Jan. 22, 2013] [retrieved from Gerbing's website] (pdf) http://www.gerbing.com/Products/insoles.php.

[Online] [retrieved on Jan. 22, 2013] [retrieved from Heat Factory website] (pdf) http://www.heatfactory.com/english/product.pht?cat=3&id.

[Online] [retrieved on Jan. 22, 2013] [retrieved from Dr. Rosenberg's Foot Products website] (pdf) http://www.instantarches.com/cool-soles.shtml.

[Online] [retrieved on Jan. 22, 2013] [retrieved from Mean and Green website]web page] (pdf) http://www.meanandgreen.com/army/-Thermal-Foil_insoles/2660/2303.html.

[Online] [retrieved on Jan. 22, 2013] [retrieved from Superfeet website] (pef) http://www.superfeet.com/products/REDHot.aspx.

[Online] [retrieved on Jan. 22, 2013] [retrieved from Thermo Soles website] (pdf) http://www.thermosoles.com/.

[Online] [retrieved on Jan. 22, 2014] [retreived from Warmers.com website] (pdf) http://www.warmers.com/grabber-got-warmers-medium-5-hour-10pr-bundle.

PCT, International Search Report & Written Opinion of the International Searching Authority for PCT/US2013/026932. dated Jun. 18, 2013.

PCT, International Search Report & Written Opinion of the International Searching Authority for Counterpart International Patent Application No. PCT/US2006/014681. dated Mar. 13, 2007.

PCT, International Search Report & Written Opinon of the International Searching Authority for Counterpart International Pataent Application No. PCT/US2006/014681. dated Jul. 27, 2006.

PCT, International Search Report & Written Opinon of the International Searching Authority for Counterpart International Pataent Application No. PCT/US2006/014681. dated Nov. 12, 2013.

http://www.instantarches.com/cool-soles.shtml. Printed Jan. 22, 2013.

http://www.geldoctor.com/flosole.html. Printed Jan. 22, 2013.

http://www.superfeet.com/products/REDHot.aspx. Printed Jan. 22, 2013.

http://www.thermosoles.com/. Printed Jan. 22, 2013.

http://gerbing.com/Products/insoles.php. Printed Jan. 22, 2013.

https://www.warmers.com/grabber-foot-warmers-medium-5-hour-10-pair-bundle/. Printed Jan. 22, 2013.

http://www.heatfactory.com/english/product.php?cat=3&id=31. Printed Jan. 22, 2013.

http://www.meanandgreen.com/army/-/Thermal_Foil_Insoles/2660/2303.html. Printed Jan. 22, 2013.

http://www.footscience.com/products_foot.htm. Printed Jan. 22, 2013.

* cited by examiner

FLOW INSOLE

CROSS REFERENCE TO RELATED APPLICATIONS

This application is a continuation of U.S. application Ser. No. 13/363,296, filed Jan. 31, 2012, which claims the benefit of U.S. provisional application 61/438,963, filed Feb. 2, 2011, and U.S. provisional application 61/509,979 filed Jul. 20, 2011.

STATEMENT REGARDING FEDERALLY SPONSORED RESEARCH OR DEVELOPMENT

Not applicable.

TECHNICAL FIELD

This invention relates to the field of replacement insoles for shoes.

BACKGROUND

Shoes, particularly athletic shoes, generally have an insole placed within the foot-receiving compartment when sold. The insole is positioned so that the user's foot will rest thereon while wearing the shoe. Generally, such insoles are removable and may be replaced with insoles which may employ various features of benefit to the user or the particular needs of the user's feet.

Wearing shoes may cause the temperature of the wearer's feet to rise. The feet can even become hot, particularly if the wearer is exercising. A normal bodily reaction to overheating is sweating. Thus, on occasion, a user's foot is hot and releases fluid in the form of sweat. While the foot is wearing the shoe, the heat and sweat can cause discomfort, odor, and other undesirable results.

On other occasions, in certain weather conditions, or due to the nature of a user's body temperature, feet can become chilled even while wearing shoes and additional warmth to the feet is needed.

DETAILED DESCRIPTION

Figure 1:
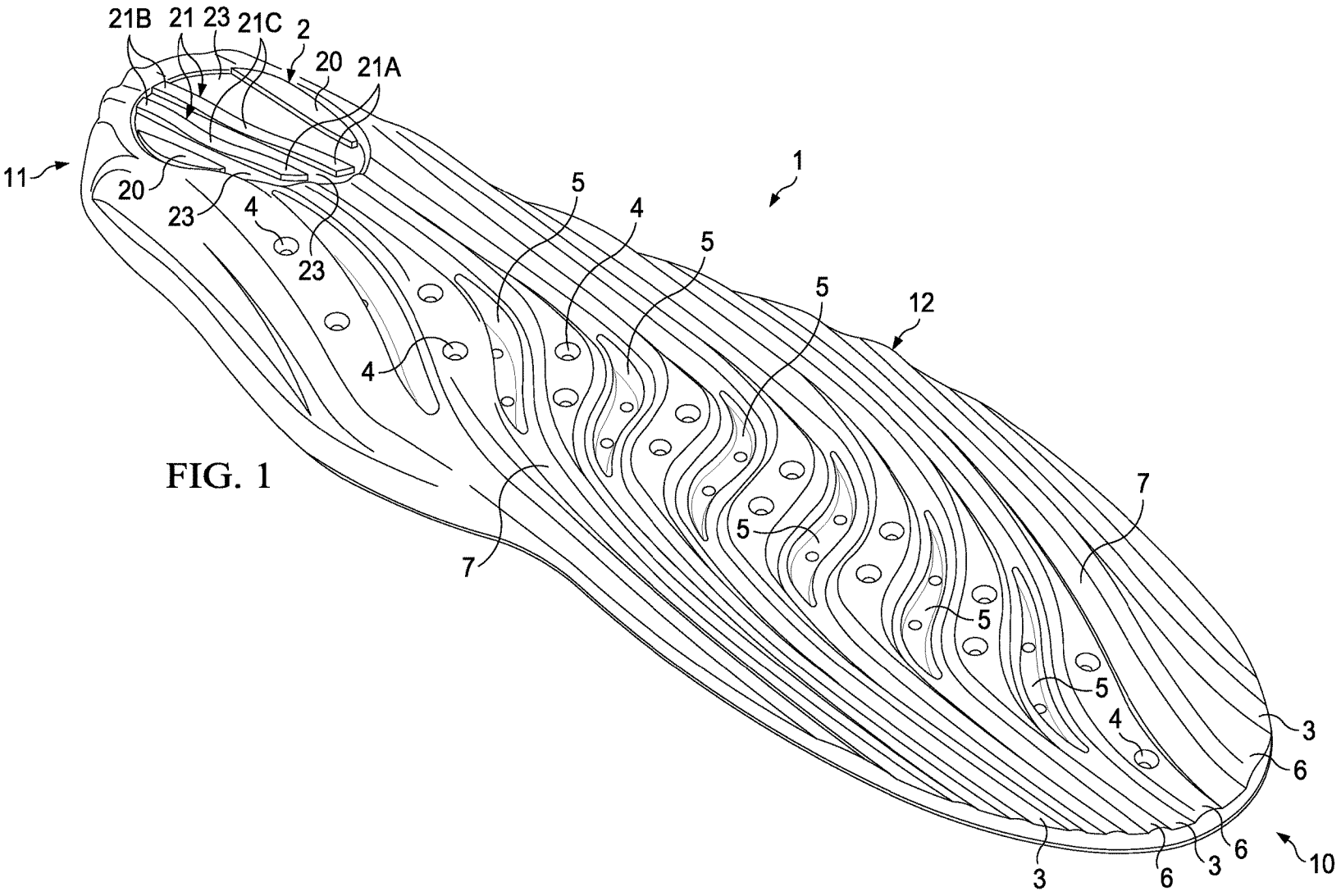
FIG. 1 is a perspective view of an embodiment of the present invention designed for cooling the right foot of a wearer.

An insole is now described which has a structure which addresses the heat and sweat released by a wearer's foot by enabling generation of an air flow which assists in convective heat transfer away from the plantar surface of the foot. This heat transfer causes the user's foot to feel cooler, and thus the body's natural tendency to sweat is also reduced. In preferred embodiments, the materials used for the insole structures increase heat transfer away from the foot. An alternate embodiment, which has a construction that enhances heat retention to help warm a user's foot, utilizes the generated air flow to help circulate the warm air.

The insole is adapted to be placed inside a user's shoe during use. Preferably, the insole is used to replace rather than augment any insoles that may already reside in the user's shoe.

The insole has a top side which is a substrate for foot contact and a bottom side which lies adjacent the inside of the user's shoe during use.

A first embodiment of the insole for cooling the feet during use preferably comprises at least two layers, a top layer and a bottom layer. The top layer serves as the substrate for foot contact by the user and preferably consists of a fabric or cloth that assists in thermal regulation of the foot. Preferably, the top layer is a cloth material useful in controlling the relative humidity in the shoe and is constructed of moisture wicking material to assist in moving moisture (perspiration) to the outer edges of the insole. The moisture can then be transferred to the shoe exterior and/or exposed to air for evaporative cooling.

A second embodiment of the insole for warming the feet during use preferably comprises a top layer, a middle layer and a bottom layer. The top layer preferably consists of a fabric or cloth that assists in thermal regulation of the foot. Preferably, the top layer is a fabric which has temperature regulating properties. This top layer interacts with the skin temperature of a user's foot to provide a buffer against temperature variations. The fabric preferably absorbs and stores excess heat from the feet, then can release the heat when needed to warm the feet. Preferably, the fabric is 100% polyester and incorporates a phase change material available from Outlast Technologies, Boulder, Colo.

In a less preferred embodiment, the insole has a single layer having the structure of the bottom layer described herein. In such case, the substrate for foot contact by the user is a top surface of the single layer, which single layer has a structure identical to that of the preferred cooling embodiment illustrated in FIG. 3 except for lacking a separate top layer. Henceforth, it should be understood that the bottom layer of the first embodiment and the single layer of the less preferred embodiment have the same structure. The second embodiment for foot warming may be altered so as not to employ a top layer and will comprise two instead of three layers in such circumstances. The structure will be referred to as the bottom layer regardless of whether it is a single layer, a second layer or a third layer of the insole.

For said first embodiment, preferably a cooling textile which contains a special low temperature jade obtained from a natural source is employed for the top layer. The form of jade in the textile is a jadeite.

The bottom layer of the first embodiment insole is preferably comprised of a thermally conductive material which assists in the transfer of heat away from the foot. One suitable material is thermally conductive ethylene vinyl acetate ("EVA"). To provide thermally conductive properties to the EVA, magnesium oxide (MgO) can be incorporated as a filler. Approximately 12% MgO provides desired thermally conductive properties, but lesser or greater amounts of filler can be used as long as the amount does not adversely affect EVA molding or stability. Thermally conductive material provides an efficient path for heat as the heat travels from the plantar surface of the foot to the interface between the insole and the shoe. At this interface, heat is dissipated by convection, conduction and radiation.

Other materials besides thermally conductive EVA can be used for the bottom layer as well, but if a thermally conductive material is used, the overall performance of the insole is improved because heat can be transferred from a user's foot to the material more quickly and efficiently. Other fillers instead of or in addition to MgO could be employed to provide the EVA with the thermally conductive properties. An example of another filler is boron nitride.

The hardness of the EVA material is preferably about 45 Asker C ±3. An appropriate hardness is provided so that the insole supports the foot at a rest position (i.e. when a user is standing on the insole as positioned in the user's footwear and the air channels are essentially uncollapsed) but so that the air channels are able to collapse when increased pressure is applied as when the user walks or runs.

For said second embodiment, the insole preferably comprises a top layer, a middle layer and a bottom layer. The top layer is a substrate for foot contact by the user and preferably consists of a fabric or cloth that assists in thermal regulation of the foot. Preferably, the top layer is a fabric which has temperature regulating properties. This top layer interacts with the skin temperature of a user's foot to provide a buffer against temperature variations. The fabric preferably absorbs and stores excess heat from the feet, then can release the heat when needed to warm the feet. Preferably, the fabric is 100% polyester and incorporates a phase change material available from Outlast Technologies, Boulder, Colo.

An antimicrobial treating material may be incorporated into the top layer or used to treat it. A preferred antimicrobial treating material is available from Aegis Environmental Management (USA). The Aegis® Microbe Shield technology forms a solid structure of polymer spikes that ruptures the cell walls of odor-causing microbes, rendering them ineffective. The technology can be infused into all materials that come into direct contact with the foot.

Alternatively, a chemical or biological agent may be used to treat the top layer for odor and/or antimicrobial resistance.

Figure 18:
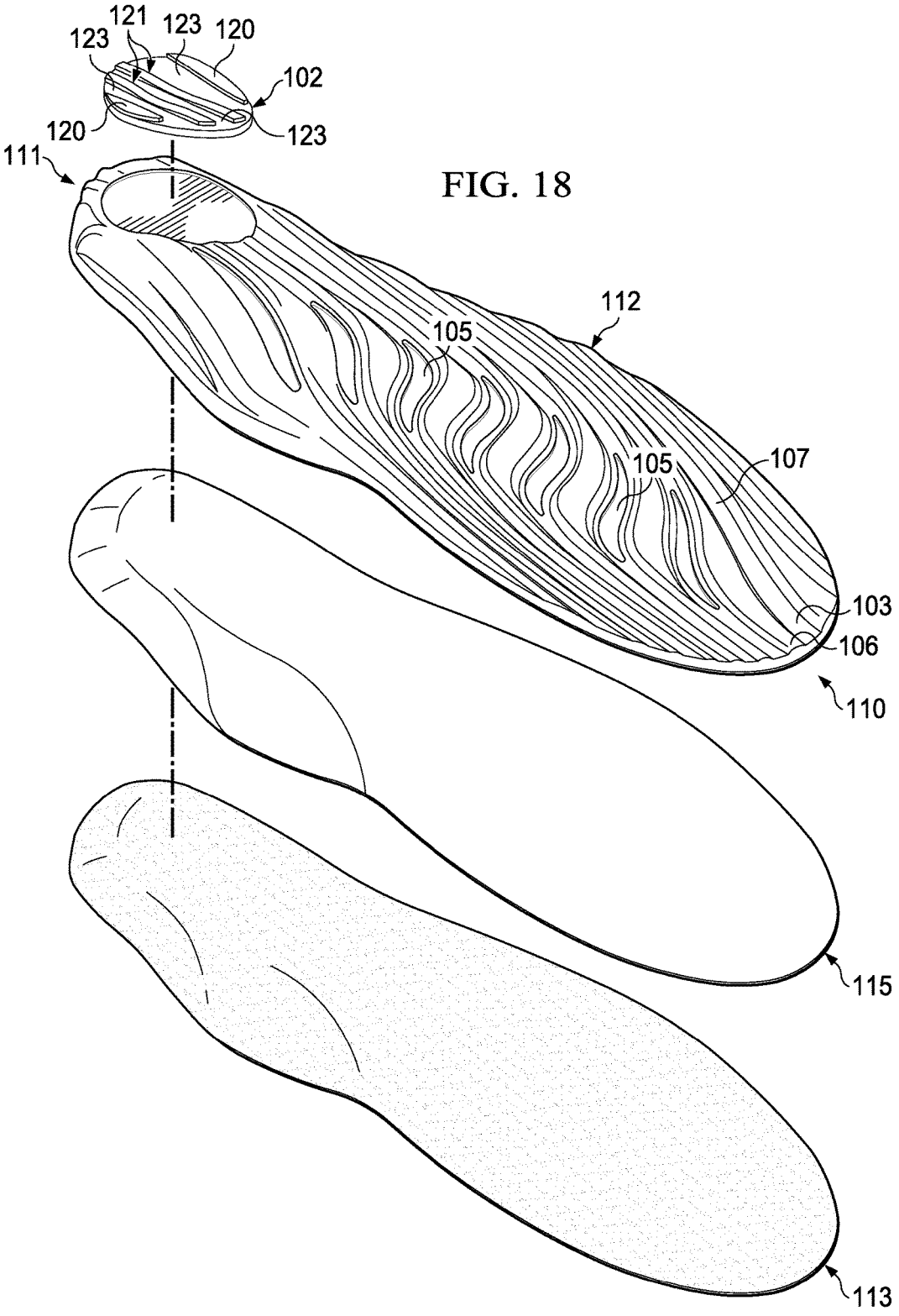
FIG. 18 is an exploded view of an embodiment of the present invention designed for warming the right foot of a wearer.
Figure 19:
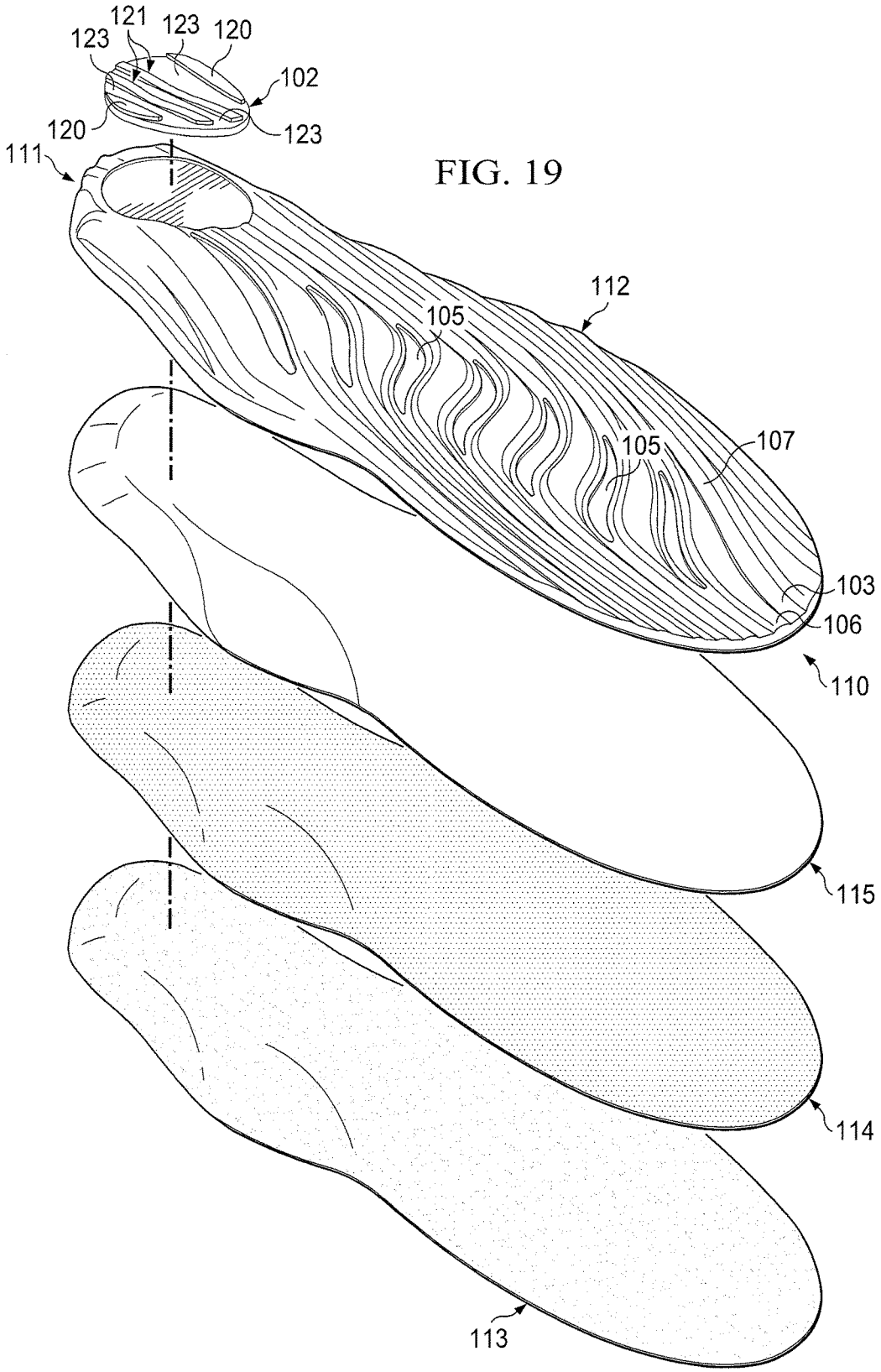
FIG. 19 is an exploded view of an embodiment of the present invention showing a secondary middle layer (114) situated between top layer (113) and middle layer (115).

Adjacent to and coextensive with the top layer of the second embodiment is a middle layer (115) comprising a thermal reflective barrier, shown in FIG. 18. This layer may be a reflective foil layer, preferably an ultra-thin foil layer. The middle layer helps capture and retain heat in the insole. Alternatively, a secondary middle layer (114), shown in FIG. 19, may be used adjacent to said top layer (113) and said middle layer (115) to aid with the adhesion of the layers (113), (114) and (115). The secondary middle layer (114) is preferably an EVA layer of about 1.5 mm.

The bottom layer of the second embodiment of the insole is preferably made of an insulated base material. An appropriate insulated base material is Ethylene vinyl acetate (also known as EVA) is the copolymer of ethylene and vinyl acetate. Another material that can be used is polyurethane foam or "PU" foam. The base material should also be selected to provide support for the user's foot, particularly arch support. The bottom layer has a heel portion, an arch portion, and a toe portion.

Now turning to the Figures, it should be understood that in the usual case, a user will employ a pair of insoles in a given pair of shoes—one for the right shoe/foot and one for the left/shoe foot. The right and left insoles are mirror images of each other so that they adapt to a typical user's right and left shoes and feet. For purposes of illustration, a right insole is depicted in the Figures and it should be understood that a corresponding left insole is within the scope of the invention and the left insole is a mirror image of the right insole.

A typical user of insole will install it as a replacement insole in a shoe with portions of bottom layer resting on the inner bottom surface of a shoe, leaving top layer visible to the user before donning the shoe. The user will don the shoe in a typical manner at which time the user's foot will be in direct or indirect contact with top layer, depending whether or not the user also wears socks or hosiery whereupon indirect contact will occur.

Figure 2:
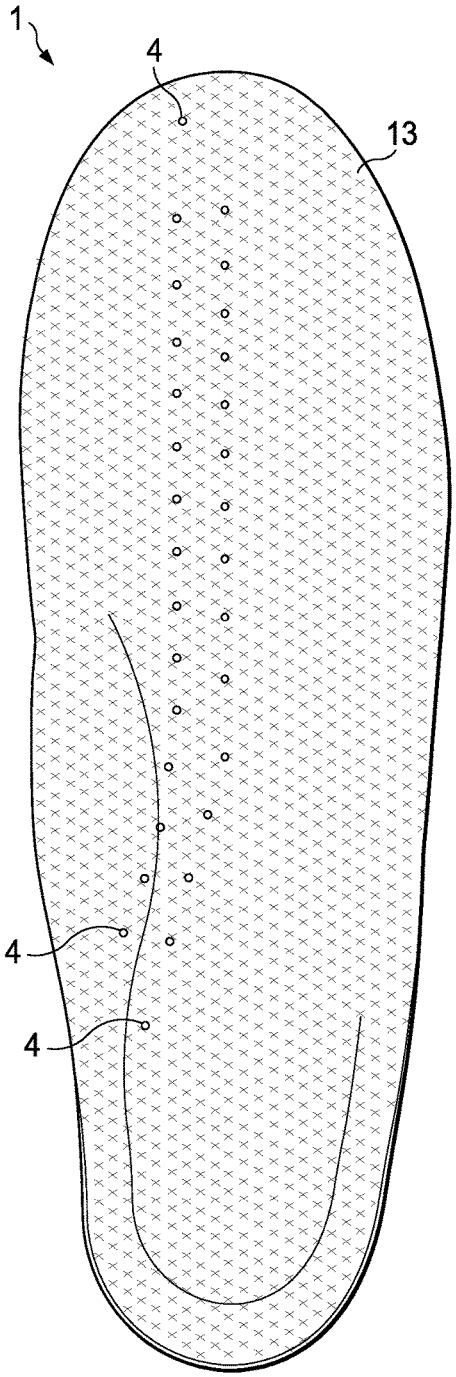
FIG. 2 is a top view of an embodiment of the present invention designed for cooling the right foot of a wearer.
Figure 3:
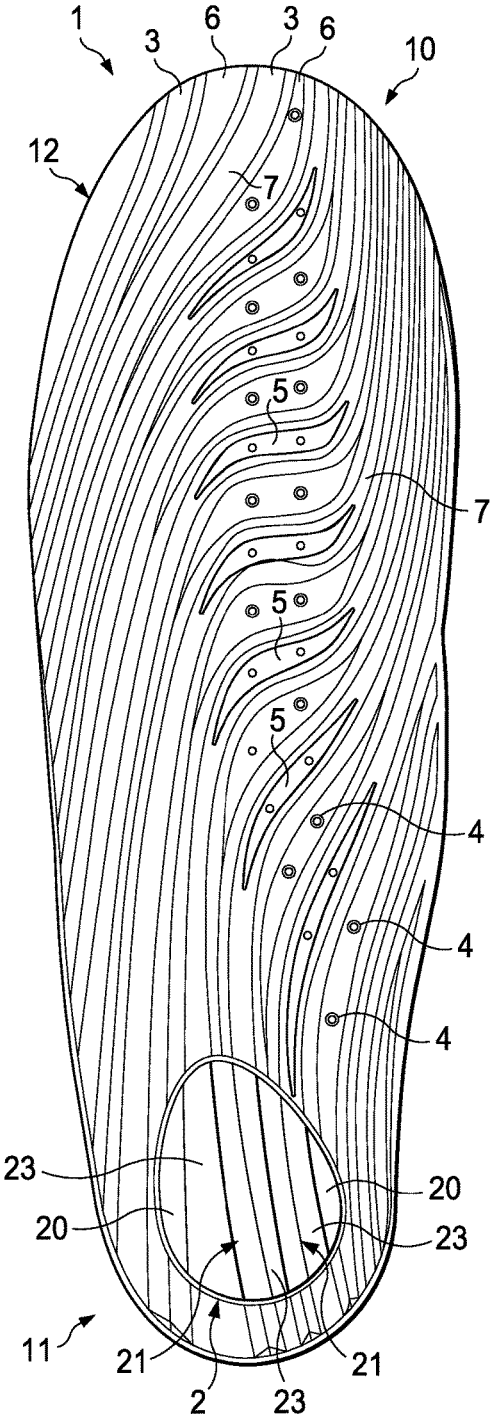
FIG. 3 is a bottom view of an embodiment of the present invention designed for cooling the right foot of a wearer.
Figure 4:
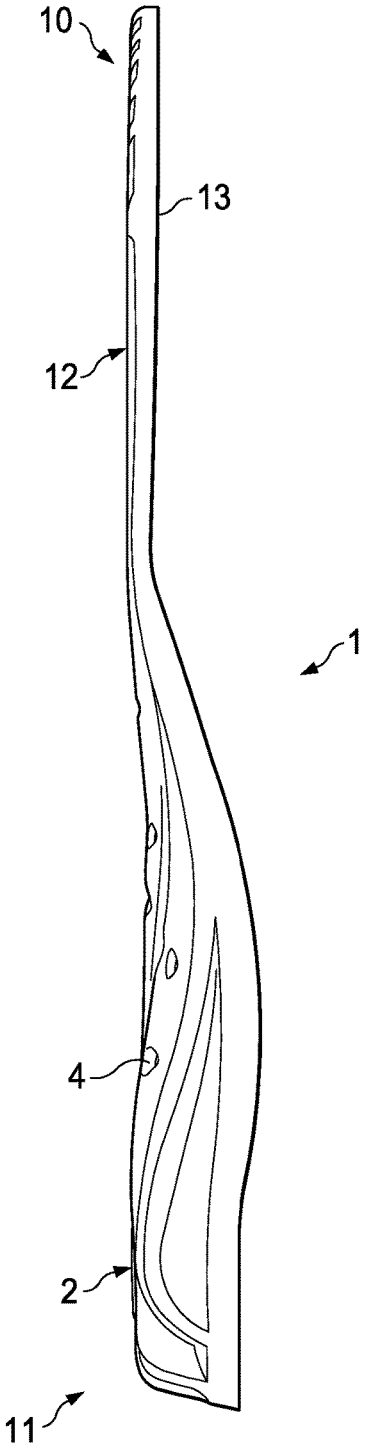
FIG. 4 is a left side view of an insole designed for cooling the right foot of a wearer.
Figure 5:
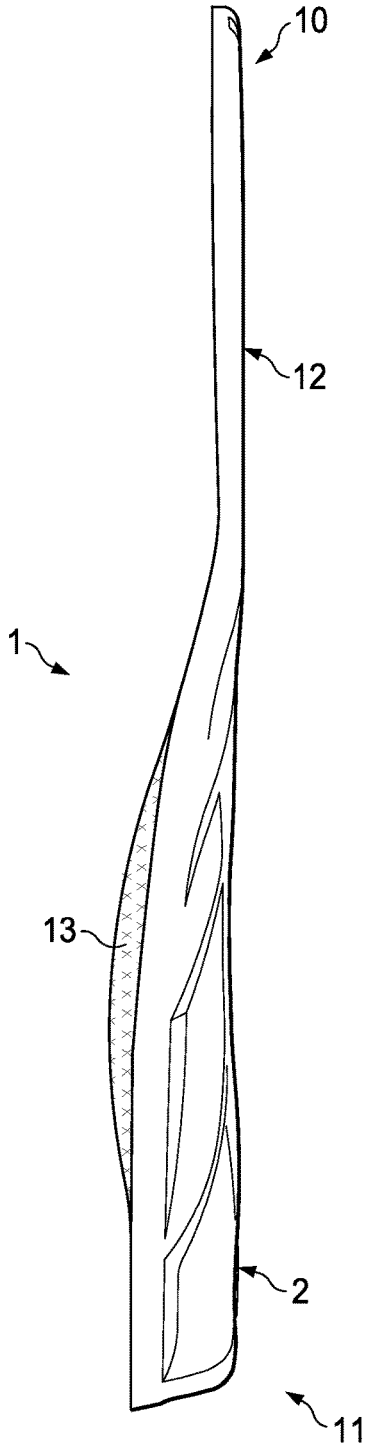
FIG. 5 is a right side view of an insole designed for cooling the right foot of a wearer.
Figure 6:
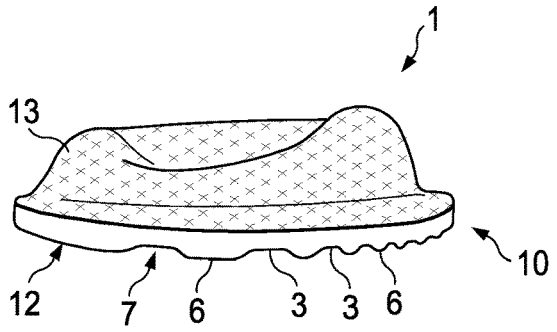
FIG. 6 is front side view of the forefoot area of an embodiment of the present invention designed for cooling the right foot of a wearer.

Now referring to said first embodiment designed for cooling the feet, the preferred insole (1) has a top layer, as best seen in FIGS. 2 and 6, (13) on which a user will rest his or her foot during use. Bottom layer (12), best seen in FIGS. 1, 3, 4, 5 and 6, is placed adjacent the inside bottom surface of a user's shoe during use. Referring to FIGS. 3 and 4, bottom layer (12) has a heel portion (11) and a toe portion (10). Bottom layer (12) defines a heel recess in heel portion (11) of sufficient depth and configuration so as to be adapted to receive concave heel pad (2) as illustrated in FIG. 3. Bottom layer (12) defines ridges (6), best seen in FIGS. 1, 3, 6 and 7 which protrude outwardly therefrom, and extend essentially lengthwise from the heel portion (11) to the toe portion (10). A plurality of air channels (7) are defined by adjacent ridges (6) and a channel lining portion (3) of the bottom layer (12) as best seen in FIGS. 1, 3 and 6 near toe portion (10). When insole (1) is placed adjacent the inside bottom surface of a user's shoe, a portion of the ridges (6) contact the inside shoe surface, thus sealing air channels (7) against that surface and forming individual pathways in which air can travel from a first location to a second location within said air channels. In a preferred embodiment of said first embodiment, heel pad (2) is concave and at least some of the air channels (7) of insole (1) are in communication with heel pad (2). This is best seen in FIGS. 1 and 3.

The configuration of the air channels (7) preferably maximizes the flow of air. The configuration is determined by ridges (6). Along one or more of the air channels (7) is an elongated recess (5) defined by the bottom layer (12). Preferably, the bottom layer (12) and top layer (13) together define air vent holes (4) which extend through both layers allowing communication of heated air, vapor/moisture and/or odiferous air from the user's foot to the area beneath insole (1). The air vent holes (4) work in conjunction with the air channels (7) to move air to and from the plantar surface of the foot.

In a preferred embodiment of said first embodiment, air vent holes (4) have a conical configuration. The widest portion of the conical air vent hole is adjacent the bottom layer (12) (See air vent hole (4) in FIG. 3) and the narrowest portion near the top layer (See air vent hole 4 in FIG. 2). The conical configuration maximizes the amount of air flow from the bottom to the top of the insole through air vent hole (4).

The projected air passing through the channel lining portion (3) combines with the heat/moisture/odiferous air in the recess (5) and then is forced by the motion of the user's heel strike and toe. Each recess (5) allows more heat/moisture/odiferous air to be transferred from the underside of the foot to the bottom of the insole (1), where this air will temporarily reside until a subsequent stream of air flows by and sweeps the air temporarily residing in the recess(es) (5) along the air channel (7).

In an alternative embodiment of said insole for cooling, no recesses or air vent holes are employed. It should be understood that one may employ recesses with air vent holes as shown in FIG. 3, recesses without air vent holes, or the alternative embodiment with no recesses or air vent holes. Although the recesses and air vent holes aid in the air flow, the insole and its channels defined on the bottom of the insole have efficacy without these additional structures.

Preferably, the first embodiment of the insole, used for cooling, will be used with athletic performance shoes which are ventilated on the shoe upper, which permit air to enter and be exhausted from a shoe during wear. Users will then typically walk or run while wearing the shoe containing the insole (1). During a walking or running motion, a user typically first makes contact with the ground with the heel of his or her shoe ("a heel strike"), then rocks the foot forward so that the toe portion of the shoe contacts the ground, whereupon the heel then begins to lift off the ground. The motion concludes with only the toe portion of the shoe in contact with the ground ("toe off"). During this typical motion of walking or running, the concave heel pad (2) is compressed by the heel strike, thus creating a displacement of air. As air is displaced, it is projected away from the heel portion (11) of the insole toward the toe portion (10) of the insole through the air channels (7). As the user's foot progresses from heel strike to toe off, the channel lining portion (3) and/or the ridges (6) collapse under the weight of the user, thereby temporarily eliminating the discreet air channels (7) under insole (1). This causes air to displace in the direction of toe portion (10). Air then circulates to the dorsal (top) of the foot where convective heat transfer will occur. The air that moves to the top of the shoe can either dissipate through the top or sides of the shoe or continue to reside in the shoe. The channels on the bottom direct airflow. Channels are preferably configured to follow the natural gait curve/path. By this it is meant that a typical gait will put pressure on the insole first on the lateral heel area and as the weight of the foot shifts to the forefoot/toes the gait shifts to the medial side of the insole. The big toe then is the greatest participant in "toe off" which is the pushing off the ground to advance the foot forward.

Heel pad (2) provides for increased cushioning of the heel upon heel strike by the user. Preferably, heel pad (2) is concave. Most preferably, heel pad (2) has outside heel ridges (20), inside heel ridges (21) and heel channel portions (23).

When heel pad (2) is concave and provided with heel ridges as described above, and positioned in the heel recess defined by bottom layer (12), the heel channel portions are essentially coplanar with the channel lining portions (3) of the bottom layer (12).

Each inside heel ridge (21) is preferably essentially curvilinear in shape and has a front end (21A), a back end (21B) and a middle portion (21C). The front end (21A) and back end (21B) each have a sufficient thickness so that when the concave heel pad is in place in said heel recess, each of said front and back ends of the inside heel ridges thereof are situated adjacent the ridges (6) of bottom layer (12), and they are of similar thickness to ridges (6) and appear essentially continuous. The middle portion (21C) of the inside heel ridges (21) comprises the top of the curvilinear shape when the insole is in use and is of a thickness less than that of the ends, so the curve gradually changes in thickness. It has a greatest thickness at the ends and the least thickness at the middle portion. The outside heel ridges (20) each have a front and back end and maintain the same thickness from said front end to said back end.

The preferred curvilinear shape of the inside heel ridges (21) is advantageous because it allows for more compression. The added compression can assist in providing more comfort/cushioning and allow more air to be displaced by a heel strike of a user. The shape formed is a cup-like area in which air may accumulate prior to the heel strike of the user. The heel pad is replenished by air drawn from around the edges of the insole. If the heel pad is compressed from the center, then air can effectively be displaced in two directions.

Most preferably, the heel pad is made of a polyurethane ("PU") material. In a most preferred embodiment, the heel pad layer measures 45 Asker C ±3. Alternative materials such as thermoplastic resin (TPR) gel can be used for the heel pad to provide desired cushioning of the heel.

Referring to FIG. 3, the preferred configuration for the air channels (3) and ridges (6) is shown. A preferred concave heel pad (2) is illustrated as secured to insole (1) within the recess defined by heel portion (11).

FIGS. 4 and 5 show the side views of insole (1). The same numbers corresponding to the parts defined in the top and bottom views are provided for clarification of position.

Referring to FIG. 6, a front view of the insole (1) is shown and toe portion (10) is a reference point. In this view, the layers of the insole (1) are best seen. The top layer (13) is secured to the bottom layer (12) side opposite the ridges (6) and channel lining portions (3) are shown. The channel lining portions (3) define the openings which are air channels (7) and these are in open communication with the interior of the shoe when in use.

Figure 7:
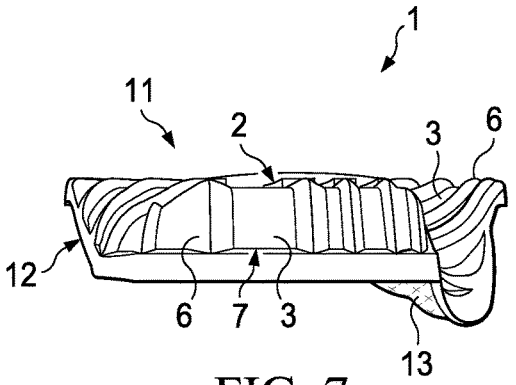
FIG. 7 is back side view of the heel area of an embodiment of the present invention designed for cooling the right foot of a wearer.

Referring to FIG. 7, the heel portion (11) is shown from an end view of insole 1). The heel portion (11) has a shape suitable to support and cradle the heel of a user and prevent it from rolling or sliding within the shoe. The ridges are the continuation of the channels.

Figure 8:
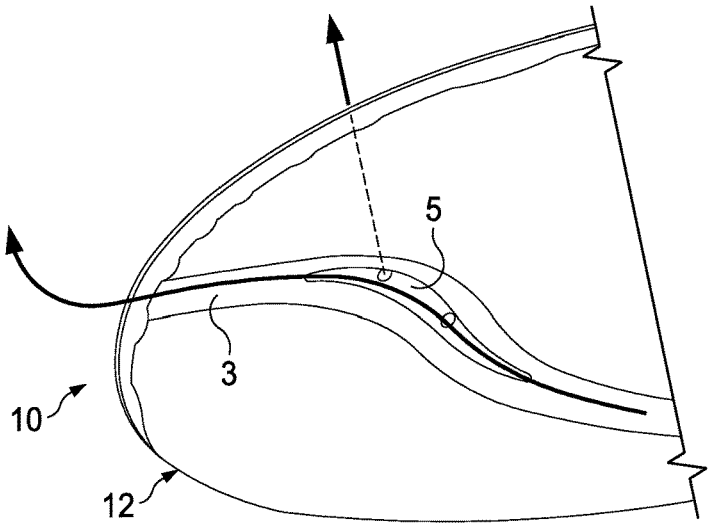
FIG. 8 is an illustrative view of a pathway air may travel.

Referring to FIG. 8, a pathway along channel lining portion (3) acts as a pathway for air movement. Air may also travel through air vent holes (4) along said pathway.

Figure 9:
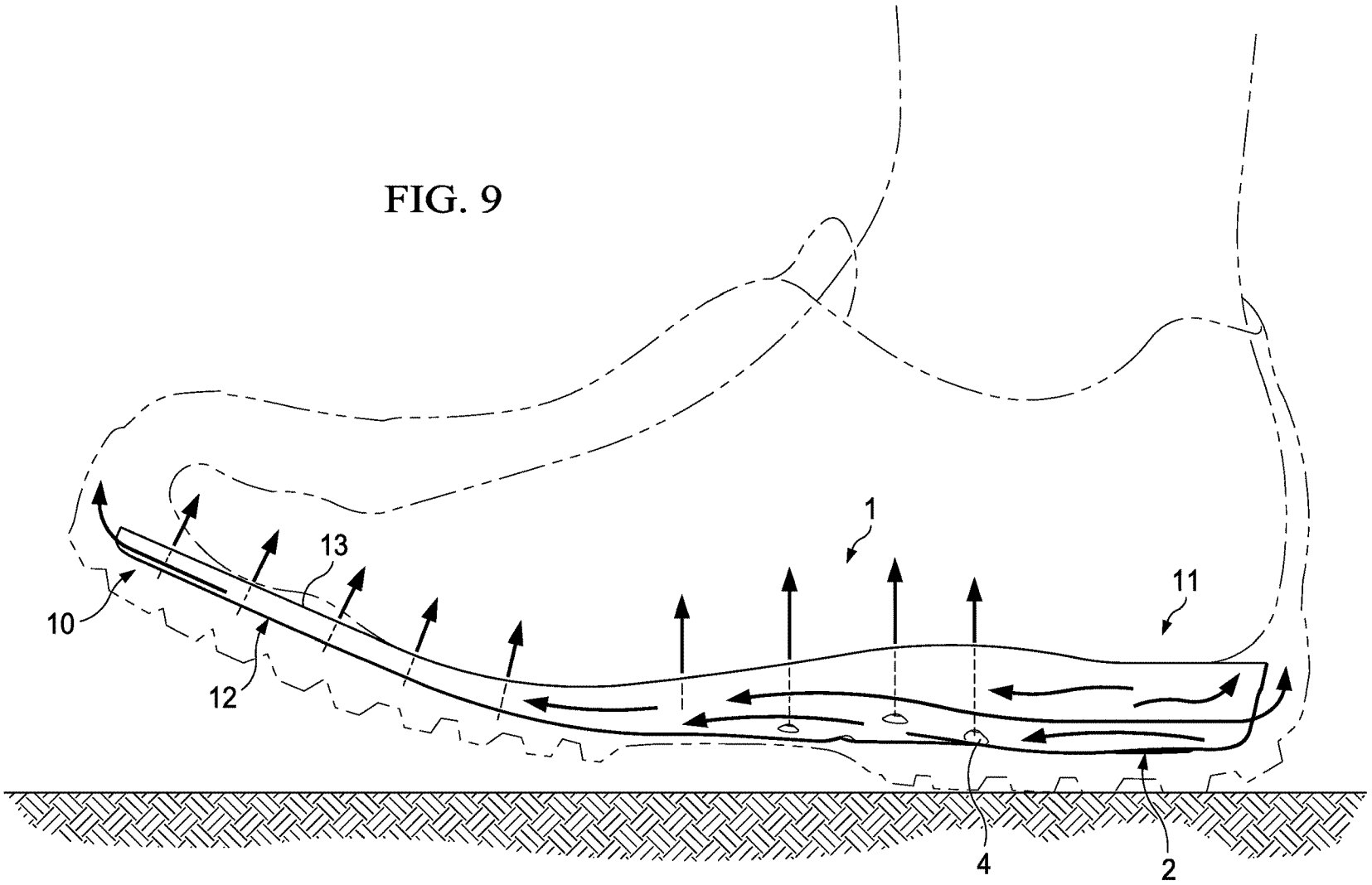
FIG. 9 is an environmental view illustrating air pathways initiated by a heel strike.

FIG. 9 illustrates an environmental view of the insole inside a shoe in use. Upon heel strike, air is pushed toward the heel portion (10) and toe portion (11) of the insole and up around the edges of the insole towards the user's foot. Air may also travel through air vent holes (4) along the pathways.

Most preferably, the concave heel pad of the cooling embodiment is made of a polyurethane ("PU") material. In a most preferred embodiment, the heel pad layer measures 45 Asker C ±3. Alternative materials such as thermoplastic resin (TPR) gel can be used for the heel pad to provide desired cushioning of the heel.

The insole of the present invention is made by a process of providing a bottom layer and a heel pad. In a preferred embodiment, a top layer is secured to the bottom layer.

The bottom layer is preferably an ethylene vinyl acetate (EVA) material with magnesium oxide (MgO). One way of creating the EVA bottom layer is to mix an EVA resin with the MgO and a foaming agent and mold it into a block or bun. The bun is sliced into thin flat sheets and then a top cloth fabric (top layer) is adhered to the said thin flat sheets. Sheets are cut to smaller panel sizes to fit compression molds. The EVA/MgO panels are inserted into compression molds with impression of the insole and compressed at a predetermined time, temperature, and pressure appropriate for the material being used. The formed panel is then removed and excess material is trimmed leaving the insole.

The heel pad is preferably a polyurethane (PU) material. One way of making the heel pad is to mix the PU components and pour the mixture into an open mold cavity having the configuration of the desired heel pad. The mold cavity is then closed and the mixture allowed to cure. The cured heel pads are then removed from the mold and excess material is trimmed.

One way to assemble the described bottom layer and heel pad is to apply adhesive to the heel pad cavity and the heel pad flat surface to mate with the bottom layer. The adhesives are activated and the heel pad positioned in the heel pad cavity and pressure applied to secure it in place.

Figure 10:
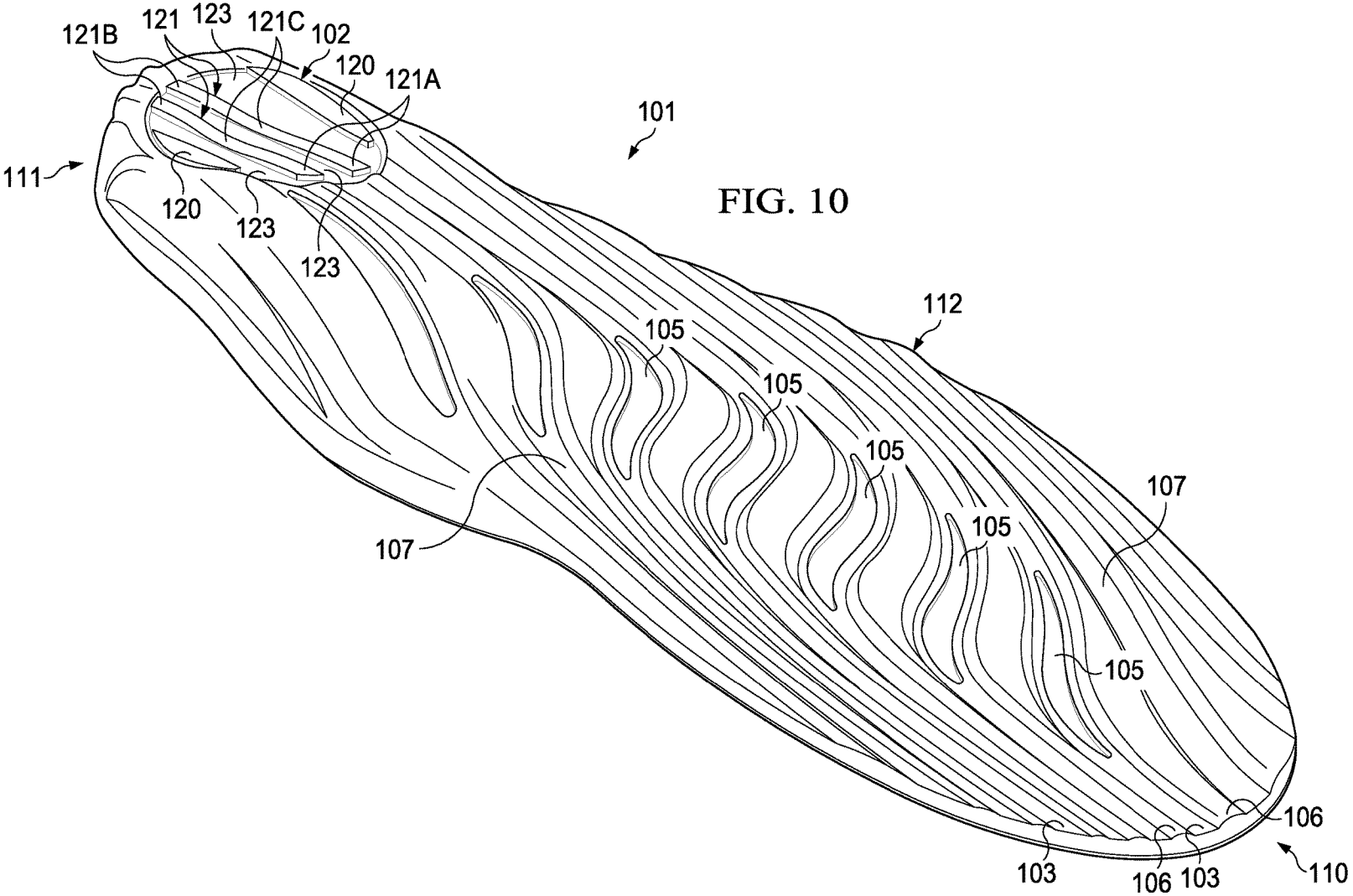
FIG. 10 is a perspective view of an embodiment of the present invention designed for warming the right foot of a wearer.
Figure 12:
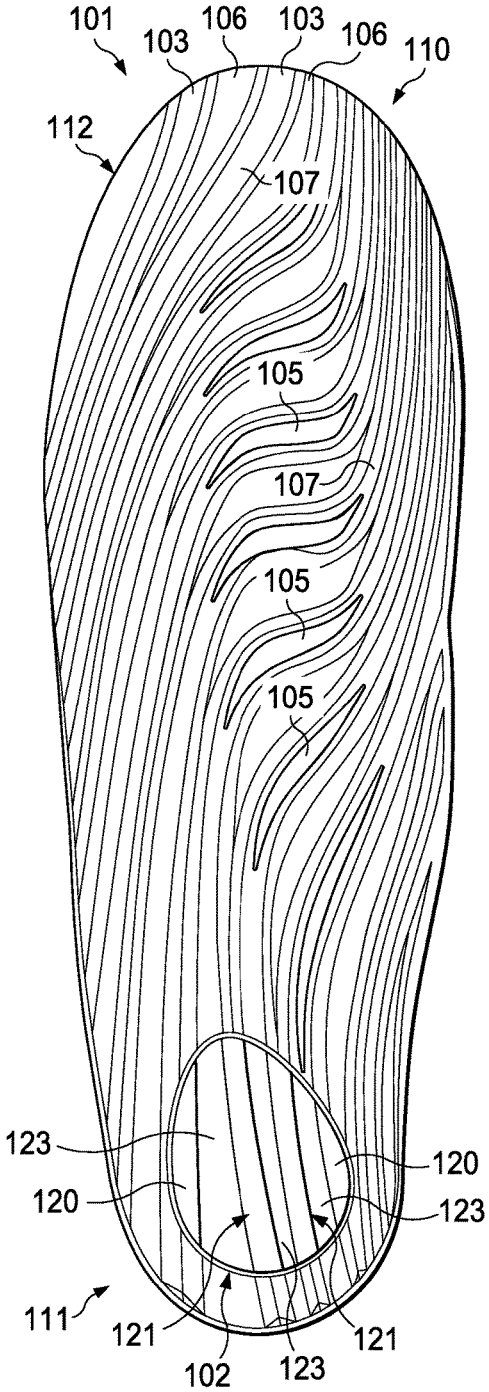
FIG. 12 is a bottom view of an embodiment of the present invention designed for warming the right foot of a wearer.
Figure 15:
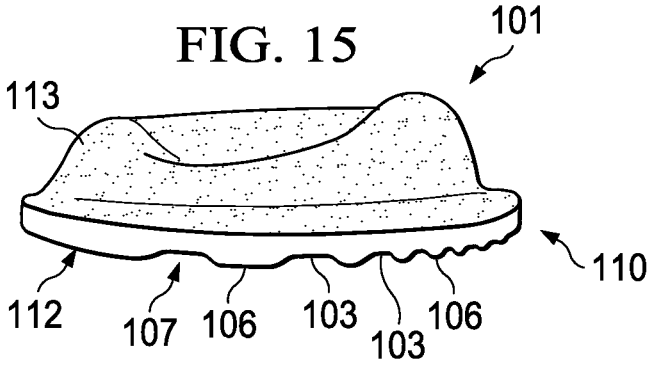
FIG. 15 is front side view of the forefoot area of an embodiment of the present invention designed for warming the right foot of a wearer.

Now referring to said second embodiment of the insole designed for warming the feet, bottom layer (112) has a heel portion (111) and a toe portion (110), as seen in FIGS. 10 and 12. Bottom layer (112) defines a heel recess in heel portion (111) of sufficient depth and configuration so as to be adapted to receive concave heel pad (102) as illustrated in FIG. 12. Bottom layer (112) defines ridges (106), best seen in FIGS. 10, 12, 15 and 16 which protrude outwardly therefrom, and extend essentially lengthwise from the heel portion (111) to the toe portion (110). A plurality of air channels (107) are defined by adjacent ridges (106) and a channel lining portion (103) of the bottom layer (112) as best seen in FIGS. 10, 12 and 15 near toe portion (110). When insole (101) is placed adjacent the inside bottom surface of a user's shoe, a portion of the ridges (106) contact the inside shoe surface, thus sealing air channels (107) against that surface and forming individual pathways in which air can travel from a first location to a second location within said air channels. At least some of the air channels (107) of insole (101) are in communication with a concave heel pad (102). This is best seen in FIGS. 1 and 3.

The configuration of the air channels (107) preferably maximizes the flow of air. The configuration is determined by ridges (106). Along one or more of the air channels (107) is an elongated recess (105) defined by the bottom layer (112). The recesses (105) help provide more air flow in the air channels (107) by pushing more air through the air channels (107) when compressed and pulling more air in when decompressed.

Preferably the second embodiment of the insole, used for warming, will be used with less ventilated shoe uppers.

In an alternative embodiment of said insole for warming, no recesses are employed. Although the recesses aid in the air flow, the insole and its channels defined on the bottom of the insole have efficacy without these additional structures.

The bottom layer preferably defines an indentation in the heel area adapted to receive a heel pad. The insole preferably further comprises a heel pad secured within said indentation to said bottom layer. Most preferably, the heel pad is concave.

Referring to FIG. 10 and FIG. 12, the concave heel pad (102) has outside heel ridges (120), inside heel ridges (121) and heel channel portions (123).

When concave heel pad (102) is positioned in the heel recess defined by bottom layer (112), the heel channel portions (123) are essentially coplanar with the channel lining portions (103) of the bottom layer (112).

Each inside heel ridge (121) is essentially curvilinear in shape and has a front end (121A), a back end (121B) and a middle portion (121C). The front end (121A) and back end (121B) each have a sufficient thickness so that when the concave heel pad (102) is in place in said heel recess, each of said front and back ends of the inside heel ridges thereof are situated adjacent the ridges (106) of bottom layer (112), and they are of similar thickness to ridges (106) and appear essentially continuous. The middle portion (121C) of the inside heel ridges (121) comprises the top of the curvilinear shape when the insole is in use and is of a thickness less than that of the ends, so the curve gradually changes in thickness. It has a greatest thickness at the ends and the least thickness at the middle portion. The outside heel ridges (120) each have a front and back end and maintain the same thickness from said front end to said back end.

The curvilinear shape of the inside heel ridges (121) is advantageous because it allows more air to be displaced by a heel strike of a user. The shape formed is a cup-like area in which air may accumulate prior to the heel strike of the user.

Referring to FIG. 12, the preferred configuration for the air channels (103) and ridges (106) is shown. Concave heel pad (102) is secured to insole (101) within the recess defined by heel portion (111).

As air is displaced it is projected into the air channels toward the toe and heel portions of the insole. As the user's foot progresses from heel strike to toe off, the air channels collapse under the weight of the user and air is moved toward the forefoot. This air movement assists in the even distribution of warm air within an enclosed shoe. During periods of inactivity, the air channels trap air and provide additional insulation to help in heat retention.

The concave heel pad (102) has outside heel ridges (120), inside heel ridges (121) and heel channel portions (123).

When concave heel pad (102) is positioned in the heel recess defined by bottom layer (112), the heel channel portions are essentially coplanar with the channel lining portions (103) of the bottom layer (112).

Each inside heel ridge (121) is essentially curvilinear in shape and has a front end (121A), a back end (121B) and a middle portion (121C). The front end (121A) and back end (121B) each have a sufficient thickness so that when the concave heel pad is in place in said heel recess, each of said front and back ends of the inside heel ridges thereof are situated adjacent the ridges (106) of bottom layer (112), and they are of similar thickness to ridges (106) and appear essentially continuous. The middle portion (121C) of the inside heel ridges (121) comprises the top of the curvilinear shape when the insole is in use and is of a thickness less than that of the ends, so the curve gradually changes in thickness.

It has a greatest thickness at the ends and the least thickness at the middle portion. The outside heel ridges (120) each have a front and back end and maintain the same thickness from said front end to said back end.

The curvilinear shape of the inside heel ridges (121) is advantageous because it allows more air to be displaced by a heel strike of a user. The shape formed is a cup-like area in which air may accumulate prior to the heel strike of the user.

Figure 13:
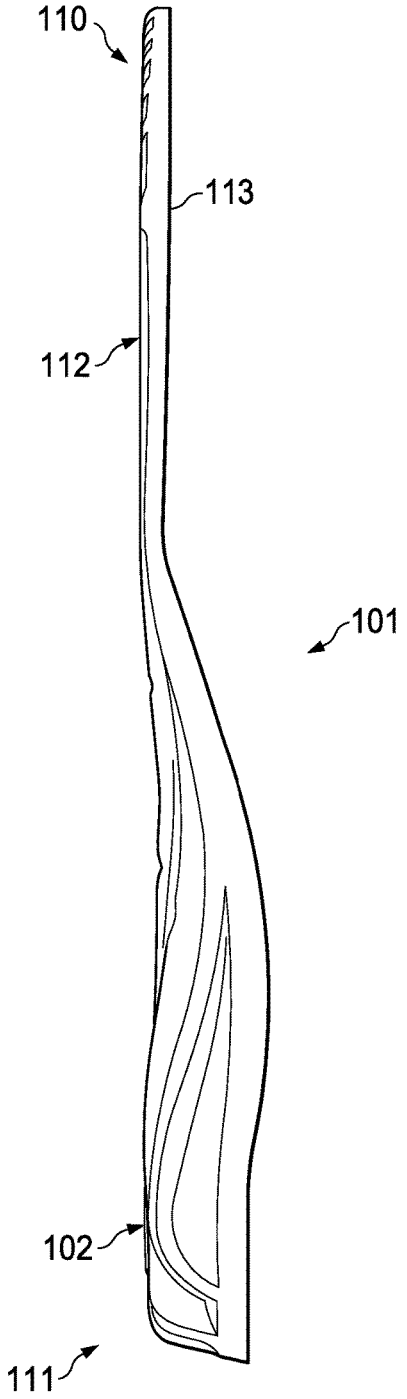
FIG. 13 is a left side view of an insole designed for warming the right foot of a wearer.
Figure 14:
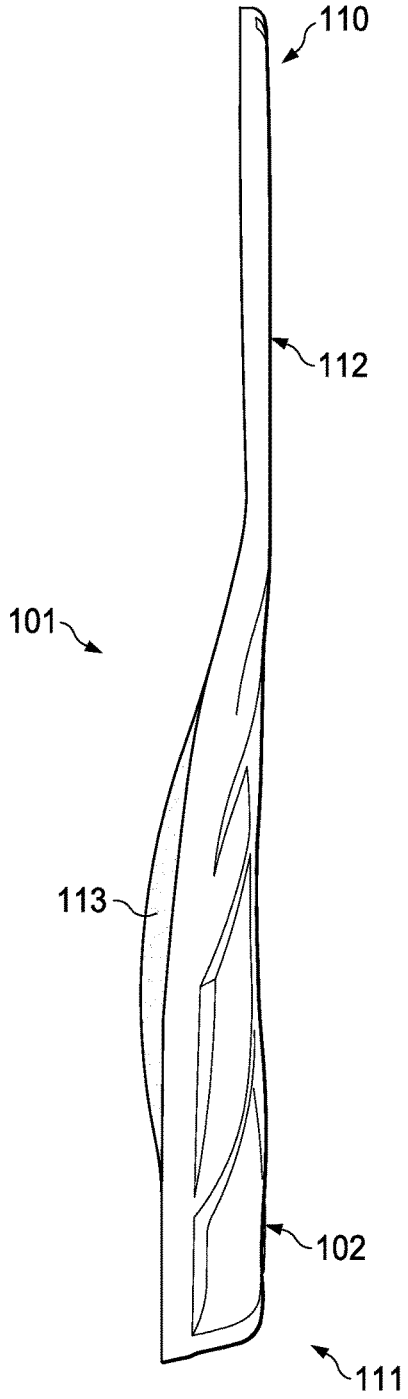
FIG. 14 is a right side view of an insole designed for warming the right foot of a wearer.

FIGS. 13 and 14 show the side views of the insole.

Referring to FIG. 15, a front view of the insole (101) is shown and toe portion (110) is a reference point. In this view, the layers of the insole (101) are best seen. The top layer (113) is secured to the middle layer (115) which is in turn secured to the bottom layer (112).

Figure 16:
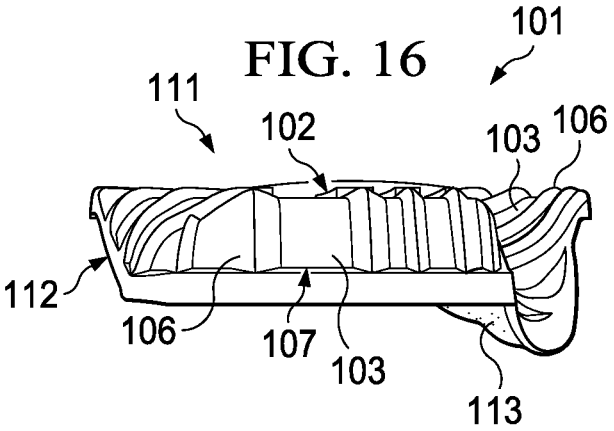
FIG. 16 is back side view of the heel area of an embodiment of the present invention designed for warming the right foot of a wearer.

Referring to FIG. 16, the heel portion (111) is shown from an end view of insole 101). The heel portion (111) has a shape suitable to support and cradle the heel of a user and prevent it from rolling or sliding within the shoe.

Most preferably, the concave heel pad of the warming embodiment is made of a polyurethane ("PU") material. A Shore/Asker Hardness test provides a measure of hardness. In a most preferred embodiment, the layer measures 45 Asker C ±3. Alternative materials such as TPR gel can be considered for the heel pad.

Figure 11:
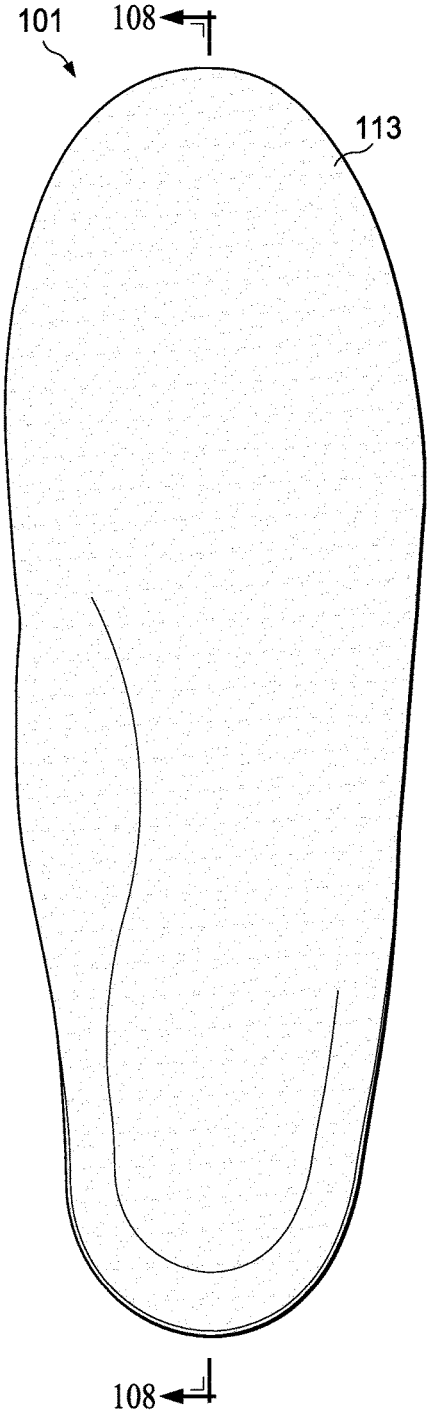
FIG. 11 is a top view of an embodiment of the present invention designed for warming the right foot of a wearer.
Figure 17:
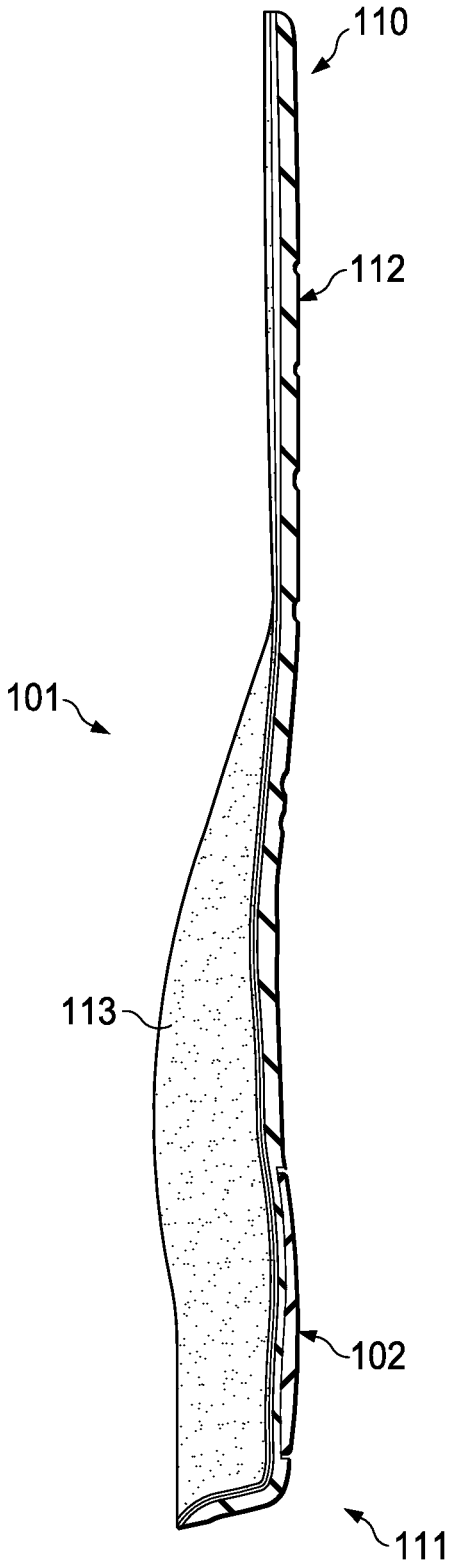
FIG. 17 is a cross-sectional view along the length line 108-108 of FIG. 11.

FIG. 17 is a cross section along line 108-108 of FIG. 11 which shows the three layers of the insole.

FIG. 18 is an exploded view showing top layer (113), middle layer (115), bottom layer (112) and a concave heel pad (102).

The total thickness and size of the insole can vary depending on the size of the shoe in which the insole is intended to be used. In an exemplary men's insole for a standard men's 10-11 (United States) shoe size, the thickest part of the toe area is about 0.24 inches and the thickest part of the arch area is about 0.43 inches. This exemplary insole is about 11.75 inches in length and has a width of about 2.70 inches near the heel and 3.86 inches near the metatarsal region. The height of the insole is from about 0.24 inches near the toe portion to 0.91 inches near the heel portion. It should be understood that the length and width of the insole will vary according to the shoe size for which the insole is intended, but the thickness in the same relative area will be similar to the exemplary insole and the areas corresponding to the heel, toe and forefoot for the various sizes defined in the art.

A thinner insole for use in selected shoe styles may be provided to accommodate essentially the length and width dimensions above but said insole has reduced thickness dimensions. For example, the reduction in thickness of the bottom layer may range from 002 inches to 0.082 inches. In one exemplary thinner insole having a length of about 11.75 inches and a width of about 2.70 inches near the heel and 3.86 inches near the metatarsal region, the thickest part of the toe area is about 0.15 inches and the thickest part of the arch area is about 0.36 inches. It can be appreciated that these exemplary dimensions may be adapted to work in conjunction with particular footwear styles as long as the function of the insole is retained.

We claim:

1. An insole comprising:

a bottom layer having a top side and a bottom side, a heel portion, a toe portion and an arch portion;

a heel pad positioned in a heel recess area in said heel portion on said bottom side of said bottom layer;

a plurality of curvilinear ridges located on bottom side of by the bottom layer and protrude outwardly from the bottom side of said bottom layer and extend essentially lengthwise along a longitudinal insole axis that extends longitudinally from the heel portion into the toe portion, said plurality of longitudinal curvilinear ridges occupy substantially the lateral width of the bottom side of said insole bottom layer;

one or more channels positioned between said curvilinear ridges and extending essentially lengthwise along said longitudinal insole axis extending essentially longitudinally from the heel portion into the toe portion in parallel with one or more of said curvilinear ridge;

a portion of one or more of said plurality of curvilinear ridges adapted to make contact with the bottom internal surface of a user's shoe, said channels forming a plurality of air channels to force air flow along an air pathway positioned in one or more of said channels;

one or more elongated recesses located on said bottom layer, said one or more elongated recesses being positioned within one or more of said channels and occupying a portion of the longitudinal length of said one or more channels;

said heel pad having inside heel ridges that each protrude outwardly from the surface of the heel pad occupying substantially the lateral width of the heel pad and having heel channels defined by the space between said heel ridges, wherein said heel ridges and heel channels extend essentially lengthwise along a longitudinal heel axis and extend essentially parallel to said longitudinal axis of said bottom layer, said heel ridges being adjacent to said curvilinear ridges of said bottom layer such that heel channels are in communication with adjacent channels in said bottom layer of said insole and assist air flow along the bottom layer.

2. The insole of claim 1, wherein said air channels formed by said ridges form individual air pathways for air flow between said heel portion and said toe portion.

3. The insole of claim 1, wherein said air channels are collapsible when pressure is applied.

4. The insole of claim 1, further comprising a top layer secured to said bottom layer and having a substrate for foot contact.

5. The insole of claim 4, wherein said substrate of said top layer comprises a moisture wicking textile that assists in thermal regulation of the foot.

6. The insole of claim 5, wherein said substrate is a cooling textile comprising jadeite.

7. The insole of claim 5, wherein said substrate is a textile comprising 100% polyester and incorporates a phase change material.

8. The insole of claim 1, wherein said bottom layer comprises ethylene vinyl acetate ("EVA"), and a thermally conductive material selected from magnesium oxide, boron nitride and combinations thereof.

9. The insole of claim 4, further comprising a middle layer secured between said top layer and said bottom layer.

10. The insole of claim 9, wherein said middle layer is a thermal reflective barrier.

11. The insole of claim 1, wherein said heel pad has a concave shape.

12. The insole of claim 11, wherein said heel pad comprises inside heel ridges that have greater thickness at the front and back portions of the heel pad and lesser thickness at a middle portion of the heel pad to form said concave shape.

13. The insole of claim 4, further comprising a secondary middle layer situated between said top layer and said middle layer.

14. The insole of claim 13, wherein said secondary middle layer comprises EVA.

15. The insole of claim 13, wherein said secondary middle layer is about 1.5 mm thick.

16. An insole comprising:

a bottom layer having a top side and a bottom side, a heel portion, a toe portion and an arch portion, a plurality of curvilinear ridges located on bottom side of the bottom layer and protrude outwardly from the bottom side of said bottom layer and extend essentially lengthwise along a longitudinal insole axis that extends longitudinally from the heel portion into the toe portion, said plurality of longitudinal curvilinear ridges occupy substantially the lateral width of the bottom side of said insole bottom layer, one or more channels positioned between curvilinear ridges and extending essentially lengthwise along said longitudinal insole axis and extending essentially longitudinally from the heel portion into the toe portion in parallel with one or more of said curvilinear ridges, a portion of one or more of said plurality of curvilinear ridges adapted to make contact with the bottom internal surface of a user's shoe, said channels forming a plurality of air channels to force air flow along said plurality of air channels forming an air pathway positioned in one or more of said channels; and said heel portion having inside heel ridges that each protrude outwardly from the bottom surface of the bottom layer of the heel portion and extend essentially lengthwise along a longitudinal heel axis that extends essentially parallel to said longitudinal axis of said bottom layer.

17. The insole of claim 16, wherein said heel portion further comprises a heel pad positioned in a recessed area in said heel portion on said bottom side of said bottom layer, said heel pad having inside heel ridges that each protrude outwardly from the surface of the heel portion occupying substantially the lateral width of the heel pad and having heel channels defined by the space between said heel ridges, wherein said heel ridges and heel channels extend essentially lengthwise along a longitudinal heel axis and extend essentially parallel to said longitudinal axis of said bottom layer, said heel ridges being adjacent to said curvilinear ridges of said bottom layer such that heel channels are in communication with adjacent channels in said bottom layer of said insole and assist in air flow along the bottom layer.

18. The insole of claim 17, wherein said heel channels formed by said heel ridges and said one or more channels form individual air pathways for air flow between said heel portion and said toe portion.

19. The insole of claim 16, wherein said air channels are collapsible when pressure is applied.

20. The insole of claim 16, wherein said bottom layer has a hardness of about 45 Asker C ±3.

21. The insole of claim 17, wherein said heel pad has a hardness of about 45 Asker C ±3.

22. The insole of claim 16, wherein said bottom layer comprises polyurethane.

23. An insole comprising:

a bottom layer having a top side and a bottom side, a heel portion, a toe portion and an arch portion, a plurality of curvilinear ridges located on bottom side of the bottom layer that protrude outwardly from the bottom side of said bottom layer and extend essentially lengthwise along a longitudinal insole axis that extends longitudinally from the heel portion into the toe portion, said plurality of longitudinal curvilinear ridges occupy substantially the lateral width of the bottom side of said insole bottom layer, one or more channels positioned between said curvilinear ridges and extending essentially lengthwise along said longitudinal insole axis longitudinally from the heel portion into the toe portion in parallel with one or more curvilinear ridges, a portion of one or more of said plurality of curvilinear ridges adapted to make contact with a bottom internal surface of a user's shoe, said channels forming a plurality of air channels to force air flow along said plurality of air channels forming an air pathway positioned in one or more of said channels;

a recessed area in said heel portion configured to receive a heel pad; and, a top layer secured to top side of said bottom layer.

24. The insole of claim 23, further comprising a heel pad positioned in said recessed area in said heel portion on said bottom side of said bottom layer.

25. The insole of claim 24, wherein said heel pad has heel ridges that each protrude outwardly from the surface of the heel pad substantially occupying the lateral width of the heel pad and defined by the space between said heel ridges, said heel ridges and said heel channels extend essentially lengthwise along a longitudinal heel axis and extend essentially parallel to said longitudinal axis of said bottom layer, said heel ridges being adjacent to said curvilinear ridges of said bottom layer such that heel channels are in communication with adjacent channels in said bottom layer of said insole and assist in air flow along the bottom layer.

26. The insole of claim 23, wherein said air channels formed by said ridges are configured to be located on the bottom internal surface of shoe and form individual air pathways for air flow between said heel portion and said toe portion.

27. The insole of claim 23, wherein said air channels are collapsible when pressure is applied.

28. The insole of claim 23, further comprising: one or more elongated recesses positioned within said channels, and being defined between said curvilinear ridges, and said one or more elongated recesses occupying a portion of the longitudinal length of said one or more channels.

29. The insole of claim 23, wherein said top and bottom layers further define air vent holes which communicate from said top to said bottom layer of said insole through which air can travel between said top and bottom layers.

30. The insole of claim 29, wherein said air vent holes are conical in configuration and have a wider end and a narrower end.

31. The insole of claim 30, wherein said wider end is adjacent said bottom side of said bottom layer and said narrower end is adjacent said top side of said bottom layer.

32. The insole of claim 29, further comprising: one or more elongated recesses positioned within said channels, and being defined between said curvilinear ridges, and said one or more elongated recesses occupying a portion of the longitudinal length of said one or more channels, wherein said vent holes are located in said elongated recesses of said bottom layer.

33. The insole of claim 29, wherein said vent holes are located on said curvilinear ridges of said bottom layer.

* * * * *